US005086734A

United States Patent [19]

Nakai

[11] Patent Number: 5,086,734

[45] Date of Patent: Feb. 11, 1992

[54] CYLINDER SLEEVE FOR TWO-CYCLE ENGINE

[75] Inventor: Hiroshi Nakai, Hamamatsu, Japan

[73] Assignee: Sanshin Kogyo Kabushiki Kaisha, Mamamatsu, Japan

[21] Appl. No.: 575,356

[22] Filed: Aug. 30, 1990

[30] Foreign Application Priority Data

Aug. 30, 1989 [JP] Japan ..... 1-221630

[51] Int. Cl.[5] ..... F02B 75/02

[52] U.S. Cl. ..... 123/65 P; 123/65 PE

[58] Field of Search ..... 123/65 PE, 65 P, 65 PD, 123/373

[56] References Cited

U.S. PATENT DOCUMENTS 4,337,734 7/1982 Iio ..... 123/65 P
4,643,140 2/1987 Whipple ..... 123/65 PE

FOREIGN PATENT DOCUMENTS 2839404 3/1979 Fed. Rep. of Germany .... 123/65 P
0248169 7/1987 Fed. Rep. of Germany ... 123/65 PE
62-32345 7/1987 Japan .

*Primary Examiner*—David A. Okonsky
*Attorney, Agent, or Firm*—Ernest A. Beutler

[57] ABSTRACT

A two-cycle, crankcase compression, internal combuston engine and a piston liner therefore having an exahust port opening that is chamfered along its top edges so as to reduce the likelihood of piston ring sticking without affecting the port timing. Different forms of chamfering tools are depicted.

9 Claims, 3 Drawing Sheets

CYLINDER SLEEVE FOR TWO-CYCLE ENGINE

BACKGROUND OF THE INVENTION

This invention relates to a cylinder sleeve for a two-cycle engine and more particularly to an improved port arrangement for a reciprocating machine and a method for forming such a port.

As is well known, many reciprocating machines, such as two-cycle engines, are ported. With such ported engines, separate valves are not employed but rather port openings are formed in the cylinder or cylinder liner and the movement of the piston controls the opening and closing of these port openings. Such constructions offer the ease of simplicity of the engine and relatively high power outputs. However, in order to insure good compression sealing, it is the normal practice to employ piston rings for the engine. With ported engines, on the other hand, there becomes a danger of piston rings sticking as the piston ring passes across the edge of the port opening. This problem is particularly relevant in connection with the passage of the piston ring across the top edge of the exhaust port opening as the piston approaches top dead center position. This is a point in time when the piston ring is traveling at the highest linear speed relative to the port opening and the sticking problem can occur.

A construction as shown in FIG. 1 has been proposed for reducing the sticking problem in connection with a port opening. In FIG. 1, a port opening constructed with a prior art type of arrangement is identified generally by the reference numeral 11. It will be seen that the port opening 11 is defined by a top edge 12, a pair of side edges 13 and a lower edge 14. In order to avoid piston ring sticking, the top edge 12 is curved.

As a result of this construction, piston ring sticking will be substantially reduced. However, it should be noted that the curvature of the top edge 12 causes the exhaust port to open gradually as the piston decreases. That is, the full transverse width of the port opening 11 is not opened immediately as the piston begins its movement toward bottom dead center. As a result of this, the scavenging of the engine will be adversely affected and the performance reduced.

It is, therefore, a principal object of this invention to provide an improved arrangement for the port opening of a reciprocating machine that will reduce the likelihood of piston ring sticking but at the same time will not adversely affect the port timing.

It is a further object of this invention to provide an improved exhaust port configuration for a two-cycle, internal combustion engine.

It is a further object of this invention to provide an improved method for forming a port in a reciprocating engine that will reduce the likelihood of piston ring sticking.

It is a further object of this invention to provide an improved method for forming the exhaust port opening of a two-cycle engine.

SUMMARY OF THE INVENTION

A first feature of this invention is adapted to be embodied in a porting arrangement for a reciprocating machine having a cylinder having a wall thickness. A port opening extends through the cylinder and is defined by a top edge, side edges and a bottom edge. A chamfered area is formed on the inner surface of the cylinder extending along a substantial width of the top edge but not through the entire wall thickness for reducing piston ring sticking without affecting the port timing of the port.

Another feature of the invention is adapted to be embodied in a method for forming a port for a reciprocating machine having a cylinder with a wall thickness and comprises the steps of forming a port opening extending through the cylinder and defined by a top edge, side edges and a bottom edge. The top edge is chamfered along the inner surface thereof so as to prevent piston sticking without affecting the port timing.

DETAILED DESCRIPTION OF THE PREFERRED EMBODIMENT

Figure 1:
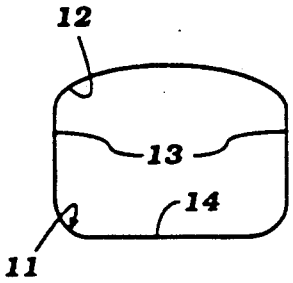
Figure 1 Prior Art
FIG. 1 is a developed view of a port opening constructed in accordance with a prior art construction.
Figure 2:
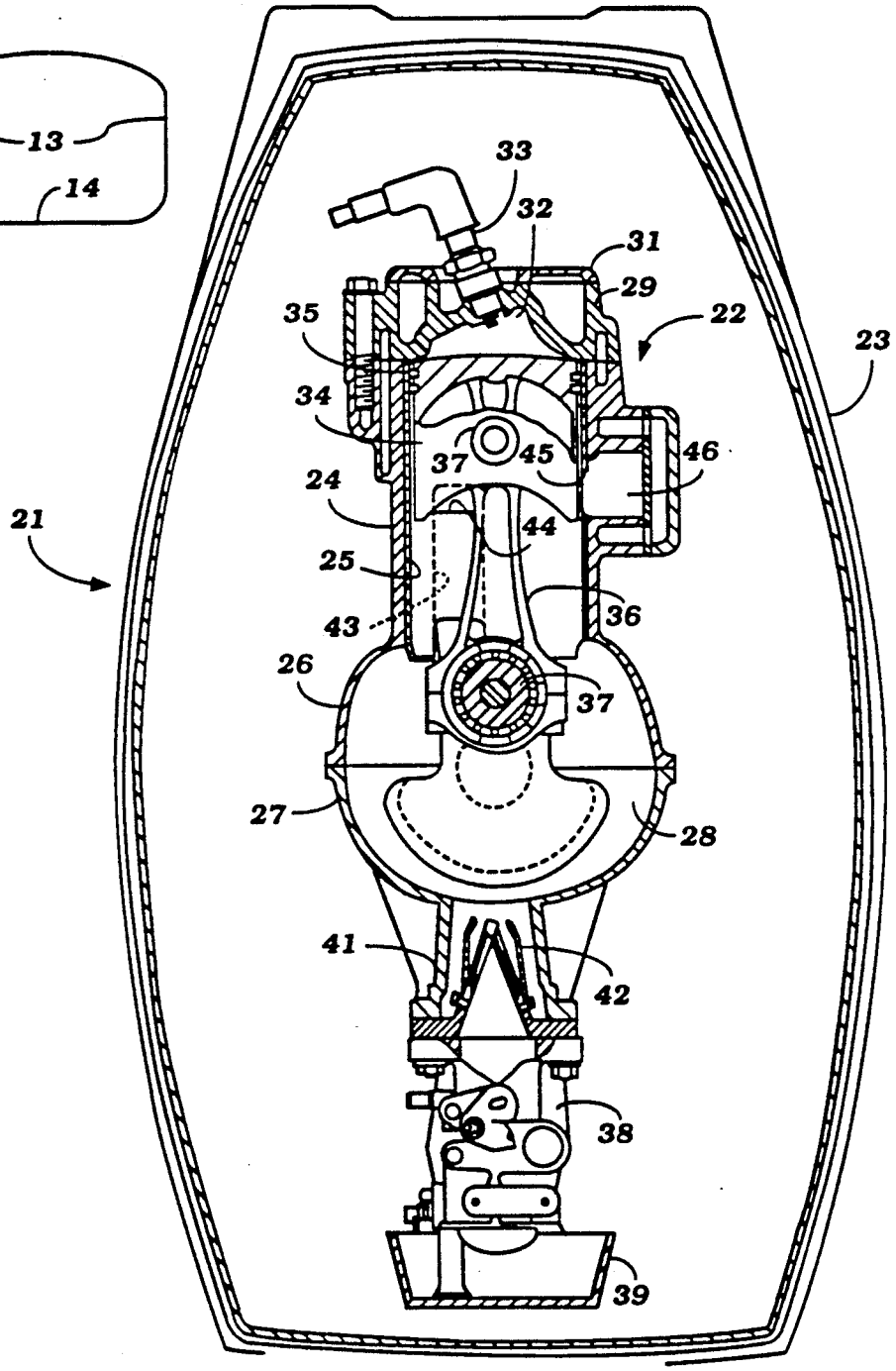
FIG. 2 is a horizontal cross-sectional view taken through the power head of an outboard motor powered by a two-cycle, crankcase compression, internal combustion engine constructed in accordance with an embodiment of the invention.

Referring first to FIG. 2, a portion of the power head of an internal combustion engine is identified generally by the reference numeral 21. The invention is described in conjunction with the power head of an outboard motor because this is a typical application for two-cycle engines and the invention has particular utility with such engines. It is to be understood, however, that the invention can be utilized in conjunction with engines applied to other uses and also with other forms of reciprocating machines.

The power head 21 includes an internal combustion engine 22 and surrounding protective cowling 23. The engine 22 is, in the illustrated embodiment, of the single cylinder type. It is to be understood, however, that the invention can be utilized in conjunction with engines having other cylinder configurations such as V-type engines and multiple cylinder engines of any configuration.

The engine 22 includes a cylinder block 24 that may be formed from a light alloy material and in which a cylinder liner 25 is inserted. The cylinder block 24 terminates in a lower skirt portion 26 to which a crankcase member 27 is affixed in a known manner so as to form a crankcase chamber 28.

A cylinder head 29 is affixed to the cylinder block 24 in a known manner and includes a further piece 31 that completes the cylinder head assembly. A combustion chamber recess 32 is formed in the cylinder head 29 and a spark plug 33 is mounted with its gap extending in this recess to fire a charge in the combustion chamber recess 32 in a known manner.

A piston 34 is slidably supported within the cylinder bore formed by the liner 25 and is provided with one or more sealing piston rings 35 that are received within grooves formed adjacent the head of the piston 34. A connecting rod 36 is connected by means of a piston pin 37 to the piston 34. The opposite end of the connecting rod 36 is journaled on a crankshaft 37 that is rotatably journaled in the crankcase chamber 28 in a known manner. As a result, reciprocation of the piston 34 will effect rotation of the crankshaft 37 in a well known manner.

A fuel/air charge is admitted to the crankcase chambers 28 from a carburetor 38 which draws air from an air inlet device 39 from the interior of the protective cowling 23. This fuel/air charge is delivered to the crankcase chambers 28 through an intake manifold 41 in which a reed type check valve 42 is positioned so as to prevent reverse flow during downward movement of the piston 34. The charge so compressed is then transferred to the area above the piston 34 through scavenge passages 43 formed in the cylinder block 24 and which terminate in scavenge ports 44 that extend through the cylinder liner 25. This charge is then fired by the spark plug 33 and is discharged through an exhaust port 45 formed in the cylinder liner 25 to an exhaust system including an exhaust manifold 46.

Figure 4:
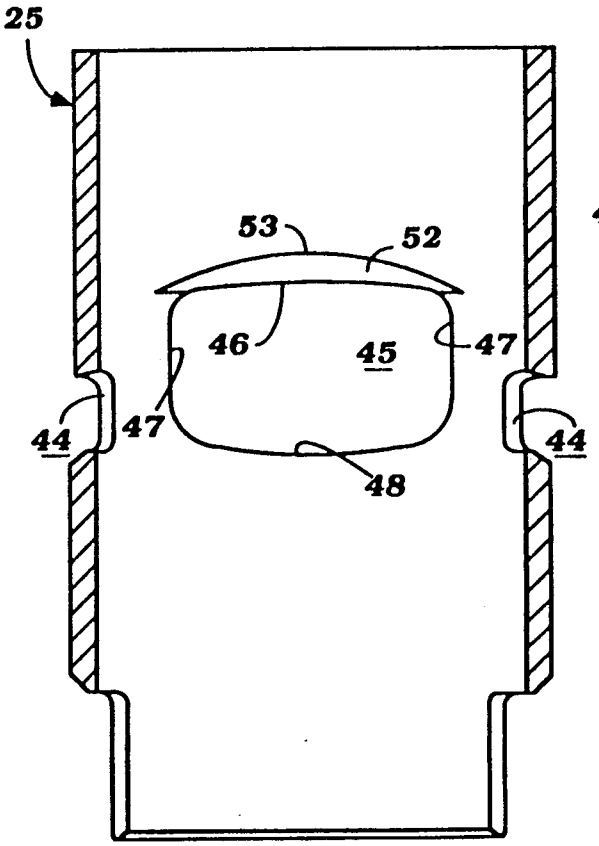
FIG. 4 is a cross-sectional view taken along a plane perpendicular to the plane of FIG. 2 and showing the initial configuration of the exhaust port after a portion of the chamfering operation.
Figure 3:
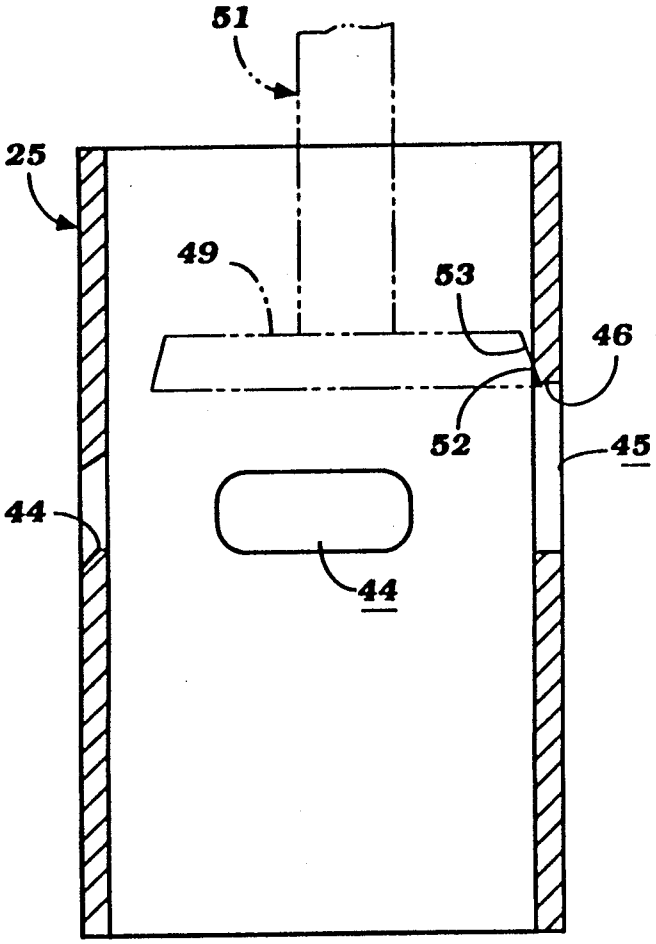
FIG. 3 is an enlarged cross-sectional view of the cylinder liner showing the method by which the exhaust port is formed.

The basic construction of the engine 22 as thus far described may be considered to be conventional and, as aforenoted, the invention deals with the manner of making of the exhaust ports 45 and their configuration. As may be best seen from FIG. 5, the configuration of the exhaust port 45 is comprised of a top edge 46, which extends generally along a horizontal plane so that downward movement of the piston 34 will cause the exhaust port 45 to be opened to its entire width as soon as the exhaust port opens. A pair of side surfaces 47 interconnect the top surface 46 with a bottom surface 48. The general configuration of the exhaust port 45 is, therefore, in a developed plane rectangular. However, in order to prevent pistons sticking, a chamfer is formed on the inner surface of the cylinder liner 25 but not so deep as to extend through its entire wall thickness. This chamfer may be formed by a rotary chamfer cutter or grinder, shown in FIGS. 5 and 6 and indicated by the reference numeral 49 that is mounted on a driven shaft 51. The tool 49 has a beveled edge so as to provide an inclined chamfered surface 52 along the upper edge of the exhaust port 45. This chamfered surface 52 provides a curved upper edge 53 as may be best seen in the FIGS. 3 through 5. However, the edge 53 and the bottom of the chamfered surface 52 does not extend through the complete thickness of the wall of the liner 25, as aforenoted. As a result, the chamfering does not at all change the port timing. After the top edge is provided with a chamfered area 52, the chamfering tool 49 may be manipulated within the cylinder so as to chamfer the side edges 47, as seen as 54, and the bottom edge 48 as seen as 55. This will further assist in reducing the likelihood of piston ring sticking without adversely affecting the port opening.

Figure 5:
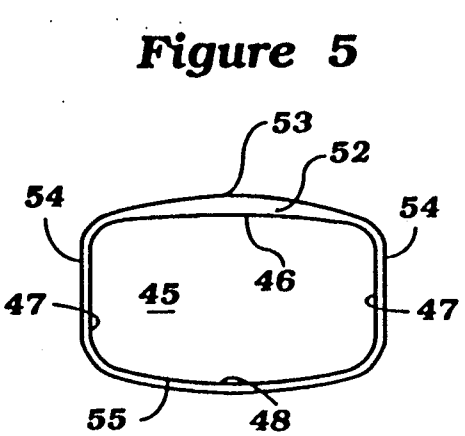
FIG. 5 is a side elevational view, in part similar to FIG. 1, and shows the finished port configuration.
Figure 6:
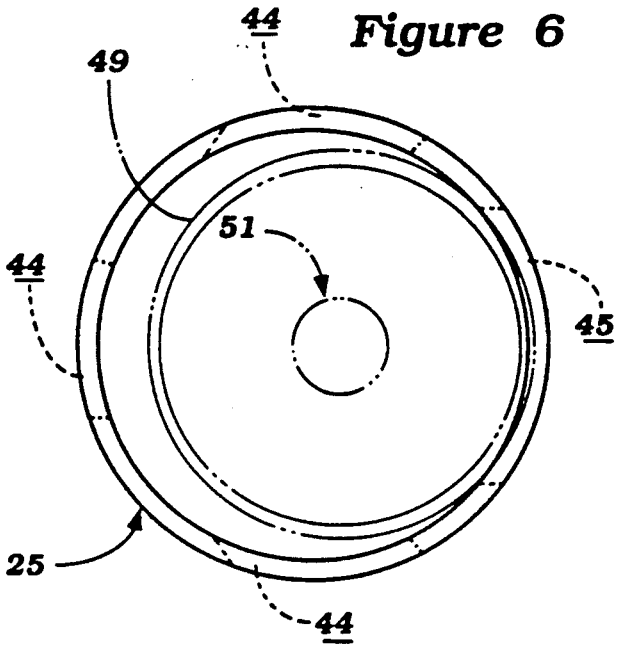
FIG. 6 is a cross-sectional view taken along a plane perpendicular to the planes of FIGS. 3 and 4 and shows the relationship of the chamfering tool to the cylinder liner.
Figure 7:
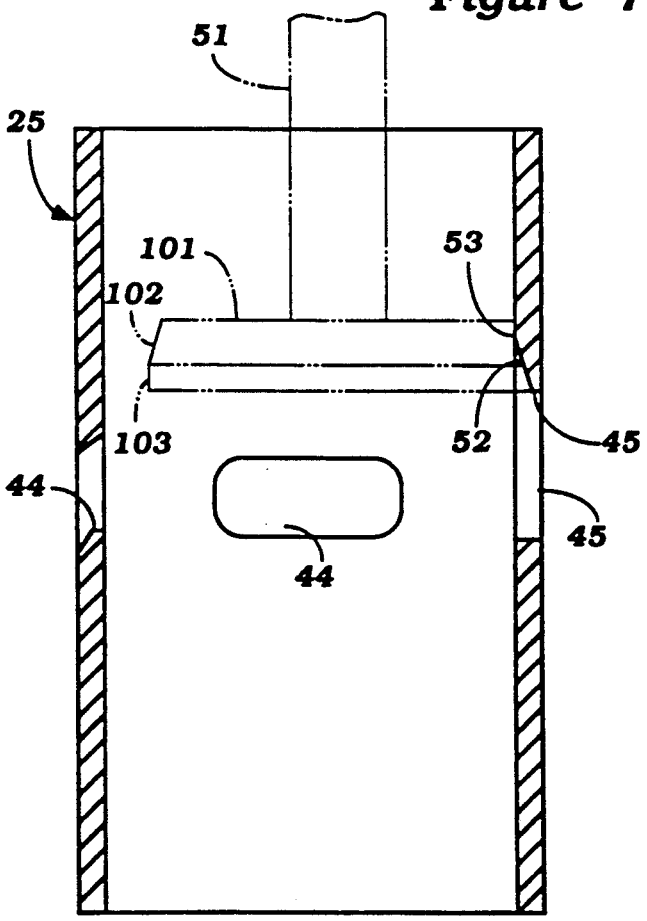
FIG. 7 is a cross-sectional view, in part similar to FIG. 3, and shows another embodiment of the invention.

FIG. 7 shows another embodiment of the invention wherein a different form of chamfering tool is employed and which will insure against deformation of the cylinder sleeve upon the chamfering operation. In this embodiment, the chamfering tool, indicated by the reference numeral 101, has a beveled surface 102 and a cylindrical surface 103. However, the finished chamfer shape for the exhaust port 45 will have the same configuration as shown in FIG. 5. In all other regards, this embodiment is the same as the previously described embodiment and, for that reason, further description of this embodiment is believed to be unnecessary.

It should be readily apparent from the foregoing description that the described embodiments of the invention provide an improved port for a reciprocating machine and method of forming it that will reduce the likelihood of piston ring sticking without adversely effecting the port timing. Although two embodiments of the invention have been illustrated, various changes and modifications may be made without departing from the spirit and scope of the invention, as defined by the appended claims.

I claim:

1. A porting arrangement for a reciprocating machine having a cylinder having a wall thickness, a port opening extending through said cylinder and defined by a top edge, side edges and a bottom edge, and a chamfered area on the inner surface on said cylinder extending along a substantial width of said top edge and providing an edge having greater curvature than said top edge for reducing piston ring sticking without affecting the port timing of said port.

2. A porting arrangement as set forth in claim 1 wherein the top edge extends substantially along a horizontal plane so that the entire width of the port is opened when the piston passes it.

3. A porting arrangement as set forth in claim 2 wherein all edges of the port are chamfered.

4. A porting arrangement as set forth in claim 1 wherein the reciprocating machine comprises a two-cycle, crankcase compression engine.

5. A porting arrangement as set forth in claim 4 wherein the port is an exhaust port.

6. A porting arrangement as set forth in claim 5 wherein the top edge extends substantially along a horizontal plane so that the entire width of the port is opened when the piston passes it.

7. A porting arrangement as set forth in claim 6 wherein all edges of the port are chamfered.

8. A method of porting a cylinder of a reciprocating machine having a wall thickness comprising the steps of forming a port opening extending through the cylinder and defined by a top edge, side edges and a bottom edge, and chamfering at least the inner surface of the cylinder along a substantial width of the top edge to provide a curved upper edge having a greater curvature than said top edge without changing the port configuration to reduce piston ring sticking without affecting the port timing.

9. A method as set forth in claim 8 wherein the entire inner surface of the port opening is chamfered as described.

* * * * *